US010914075B2

(12) United States Patent
Vandenberg et al.

(10) Patent No.: US 10,914,075 B2
(45) Date of Patent: Feb. 9, 2021

(54) HIDDEN CONSTRUCTION BRACKET AND RELATED METHOD

(71) Applicant: National Nail Corp., Grand Rapids, MI (US)

(72) Inventors: Roger A. Vandenberg, Hudsonville, MI (US); Todd E. A. Schwartzkopf, Hudsonville, MI (US)

(73) Assignee: National Nail Corp, Grand Rapids, MI (US)

( * ) Notice: Subject to any disclaimer, the term of this patent is extended or adjusted under 35 U.S.C. 154(b) by 0 days.

(21) Appl. No.: 16/735,980

(22) Filed: Jan. 7, 2020

(65) Prior Publication Data

US 2020/0217077 A1 Jul. 9, 2020

Related U.S. Application Data

(60) Provisional application No. 62/789,711, filed on Jan. 8, 2019.

(51) Int. Cl.
*E04F 11/02* (2006.01)
*E04F 11/025* (2006.01)

(52) U.S. Cl.
CPC ..... *E04F 11/025* (2013.01)

(58) Field of Classification Search
CPC ..... E04F 11/025; E04F 2011/0207
See application file for complete search history.

(56) References Cited

U.S. PATENT DOCUMENTS 4,709,520 A * 12/1987 Vochatzer ..... E04F 11/025 182/220
5,636,483 A * 6/1997 Wille ..... E04F 11/0255 182/228.1
6,758,016 B2 * 7/2004 Gobeil ..... E04F 11/00 182/228.3

(Continued)

FOREIGN PATENT DOCUMENTS

FR 2857996 A1 * 1/2005 ..... E04F 11/112
JP 2000356017 A * 12/2000

OTHER PUBLICATIONS

Invisi-Fast Hidden Deck Fastener, NFX Media, M.M. Products, Inc., downloaded Jan. 7, 2020.

(Continued)

*Primary Examiner* — Adriana Figueroa
(74) *Attorney, Agent, or Firm* — Warner Norcross + Judd LLP

(57) ABSTRACT

A bracket and related method to construct stairways is provided. The bracket includes a top horizontal leg having a first width and a first spacer of a first dimension and a second spacer of a smaller second dimension, and a vertical leg joined with the top leg, the vertical leg having a first height, with a ratio of the first width to the first height being at least 1:2. The method can include placing the top leg adjacent an underside of stair boards, selectively altering or not altering the first spacer based on a preselected gap between the boards, fastening the top leg to the underside of the boards with fasteners while the first spacer and/or the second spacer maintains the preselected gap, placing the bracket vertical leg adjacent a stringer, and fastening the vertical leg to the stringer, optionally while the installer remains above the stairway and stringer.

20 Claims, 9 Drawing Sheets

(56) References Cited

U.S. PATENT DOCUMENTS

| | | | | |
|---|---|---|---|---|
| 7,757,443 | B2 * | 7/2010 | Ringness | E04F 11/025 52/182 |
| 7,946,084 | B2 * | 5/2011 | Gibson | E04F 11/025 52/187 |
| 8,307,603 | B1 * | 11/2012 | Mitchell | E04F 11/025 52/741.2 |
| 2005/0081461 | A1 * | 4/2005 | Gibson | E04F 11/00 52/188 |
| 2009/0056268 | A1 * | 3/2009 | Greenlee | E04B 1/2608 52/702 |

OTHER PUBLICATIONS

TA Staircase Angle, Simpson Strong-Tie Product Details Website, downloaded Jan. 7, 2020.
Simpson TA10ZKT Staircase Angle Screws, Fasteners Plus, downloaded Dec. 12, 2019.

* cited by examiner

HIDDEN CONSTRUCTION BRACKET AND RELATED METHOD

BACKGROUND OF THE INVENTION

The present invention relates to construction, and more particularly to a bracket system and related method to construct stairways and other stepped structures.

Stairways typically include multiple steps situated in an ascending configuration to provide a stepped pathway from one level of a structure to another. Steps usually are supported by an underlying structure, such as two, three or more stair stringers. When a stairway is constructed from wood, for example, in a deck construction, the stringers usually are linear pieces of wood or composite material with notches cut out from them to accommodate the individual steps in a horizontal orientation. The stringers are spaced apart from one another but are generally parallel and extend vertically. The steps can be constructed from the same material as the stringers, but usually are in the form of boards or panels of a smaller dimension. Thus, many times two, three or more step boards are placed side by side to complete a step on a horizontal part of the stringer.

To prepare a multi-board step on a stringer, an installer will place a first board, cut to span the appropriate width of the stringers, across aligned, horizontal portions of the notches in the stringer. The installer will then drive a nail or advance a screw through an upper surface of the board and into the stringer. The installer will place the next board for the step adjacent the first board and repeat the process to secure the second board and complete the step. Frequently, handling and securing two or more step boards as separate pieces can require multiple trips up or down the stairway, which can consume time.

Sometimes, step boards are spaced a distance from one another to establish a gap between them. To set this gap, some installers will simply eyeball the board spacing and ensure they are uniform. With such a method, this gap can vary, and this variance can be visible and aesthetically displeasing. Other installers will use a special tool of a particular width, place it between the boards to precisely set the gap, then remove the tool after fastening the board to the stringer. Depending on the desired size of the board gap, an installer might have to carry multiple different tools, which can be burdensome.

In recent years, it has become popular to use hidden fasteners to install step boards on stairs so that the upper surface of the boards have no visible fasteners on their faces. This can be challenging, depending on the type of hidden fasteners utilized. This also can be challenging, depending on how many boards are used on a level for a step, and where and how the hidden fasteners attach the boards to the underlying stringers. Many times, to fasten down a step to a stringer, an installer will need to crawl under the steps and the stringers to get a proper angle to secure the boards. This can cause discomfort or injury to the installer in some cases.

Accordingly, there remains room for improvement in the field of constructing stairways and other structures, particularly where steps are desired to be free from visible fasteners on the faces of those steps.

SUMMARY OF THE INVENTION

A bracket and related method to construct stairways and other structures is provided.

In one embodiment, the bracket can include a top horizontal leg and a joined vertical leg extending therefrom. The two legs can form an L shape. The top leg can include a first spacer of a first dimension and a second spacer of a smaller second dimension. These spacers can be dimensioned to correspond to and to set a preselected gap between adjacent stair boards.

In another embodiment, the first and second spacers can be alterable. For example, one or both spacers can be removable, bendable, or able to be modified so that they will not be disposed between boards when the bracket is attached to the boards. In some cases, a spacer can be broken off or bent, so as to not project between adjacent boards and thereby produce or set a gap between those boards via that spacer.

In still another embodiment, the first spacer can be a larger spacer that can be altered so that only a second spacer, which is smaller in size, cross section, height, width, etc., than the first spacer, can project between boards to set the gap therebetween.

In yet another embodiment, the top horizontal leg can include a first width and the vertical leg can include a first height. The height and width can be preselected so that fasteners through the respective legs do not interfere with one another, and/or so that the legs adequately engage the stair boards and a respective stringer. The first width and the first height can be configured in a ratio of at least 1:2 to provide a particular function when the bracket is installed.

In even another embodiment, the vertical leg can include a beveled ramp to enable the bracket to be guided over and to align with a portion of a stringer when the bracket is installed relative to the stringer.

In a further embodiment, a method can be provided. The method can include placing the top leg adjacent an underside of stair boards, selectively altering or not altering the first spacer based on a preselected gap between the boards, fastening the top leg to the underside of the boards with fasteners while the first spacer and/or the second spacer maintains the preselected gap, placing the bracket vertical leg adjacent a stringer and fastening the vertical leg to the stringer, optionally while the user remains above the stairway and stringer.

In still a further embodiment, the preselected gap is smaller than the first dimension. The method can include selectively altering the first spacer so that the first spacer is not disposed between the first board and the second board. Thus, the second spacer can be disposed between the first board and the second board, optionally contacting the side surfaces of the boards, to set the preselected gap between the first board and the second board. In this case, the preselected gap can correspond to the second smaller dimension of the second spacer, rather than the first dimension of the first spacer.

In yet a further embodiment, the first and second spacers can be joined with the bracket, for example, the top leg, in a way to enable them to be altered easily. For example, the spacers can be connected at an interface to the bracket so that the spacers can be broken, bent, detached, snapped, deformed, retracted, extended or the like (collectively or individually referred to as altered herein) relative to the bracket so that a respective spacer will be unable to effectively set a gap between stair boards with which the bracket is utilized.

In another embodiment, the method can include fastening the bracket legs to the stair boards and stringer with a tool. The tool can be a power tool having a longitudinal drive axis. The bracket can enable a user to orient the drive axis substantially parallel to a longitudinal axis of the stair boards during the fastening, particularly of the vertical leg to the stringer.

In even a further embodiment, the method can include attaching the bracket to the undersides of boards and setting a gap between the boards when the boards and bracket are turned upward with fasteners, installing all the fasteners through the bracket top leg in doing so, turning the joined boards over with the bracket attached, and the bracket facing downward, and installing more fasteners through the vertical leg to join the bracket and attached boards securely with the stringer.

The current embodiments of the bracket system and related method provide benefits in stairway and other structure building that previously have been unachievable. For example, where the bracket includes two or more spacers, a user can select a preselected gap size between stair boards, then use the spacers to precisely set that gap. If one or more spacers are too large, that spacer can be adjusted, or altered, for example, removed, so that an appropriately sized spacer remains. The remaining spacer can be positioned between side surfaces of stair boards to effectively set the gap between the boards upon contact with the side surfaces. Where the bracket is constructed so the top leg width and vertical leg height are in a ratio of at least 1:2, the bracket is stable and there is plenty of room to install associated fasteners in each of the legs. Where the bracket comes preloaded with fasteners that are secured thereto, an installer or user need not fumble with fasteners to install them to the bracket then to the stringer or other boards. Where the vertical leg includes a bevel, that bevel can guide a preconstructed stair board unit including the stair boards and the bracket rapidly and consistently onto and adjacent a stringer.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

A current embodiment of the bracket is illustrated in FIGS. 1-6, and generally designated 10. The bracket 10 is described here in its utilization to connect stair boards 101, 102 to a support, such as a stair stringer 107. The bracket in such a capacity can be referred to as a stairway stringer bracket, however, such a stairway stringer bracket can also be used to join multiple other construction supports and substructures, so such a naming is not meant to be limiting. As an example, where multiple panels are to be joined with a vertical or horizontal support, and it is more convenient to join multiple panels to one another first then to the support, the stairway stringer bracket can be utilized, even though the finished structure is not a stairway, and/or is not attached to a stringer.

Further, in this disclosure, the bracket is described in connection with boards. As used herein, boards can include any type of elongated element that has a length greater than its width. Examples of boards can include wood boards, constructed from any type of wood, whether pressed wood and/or lumber, composite boards, polymeric boards, steel or metal studs, panels, sheets and other similar type construction elements.

Figure 1:
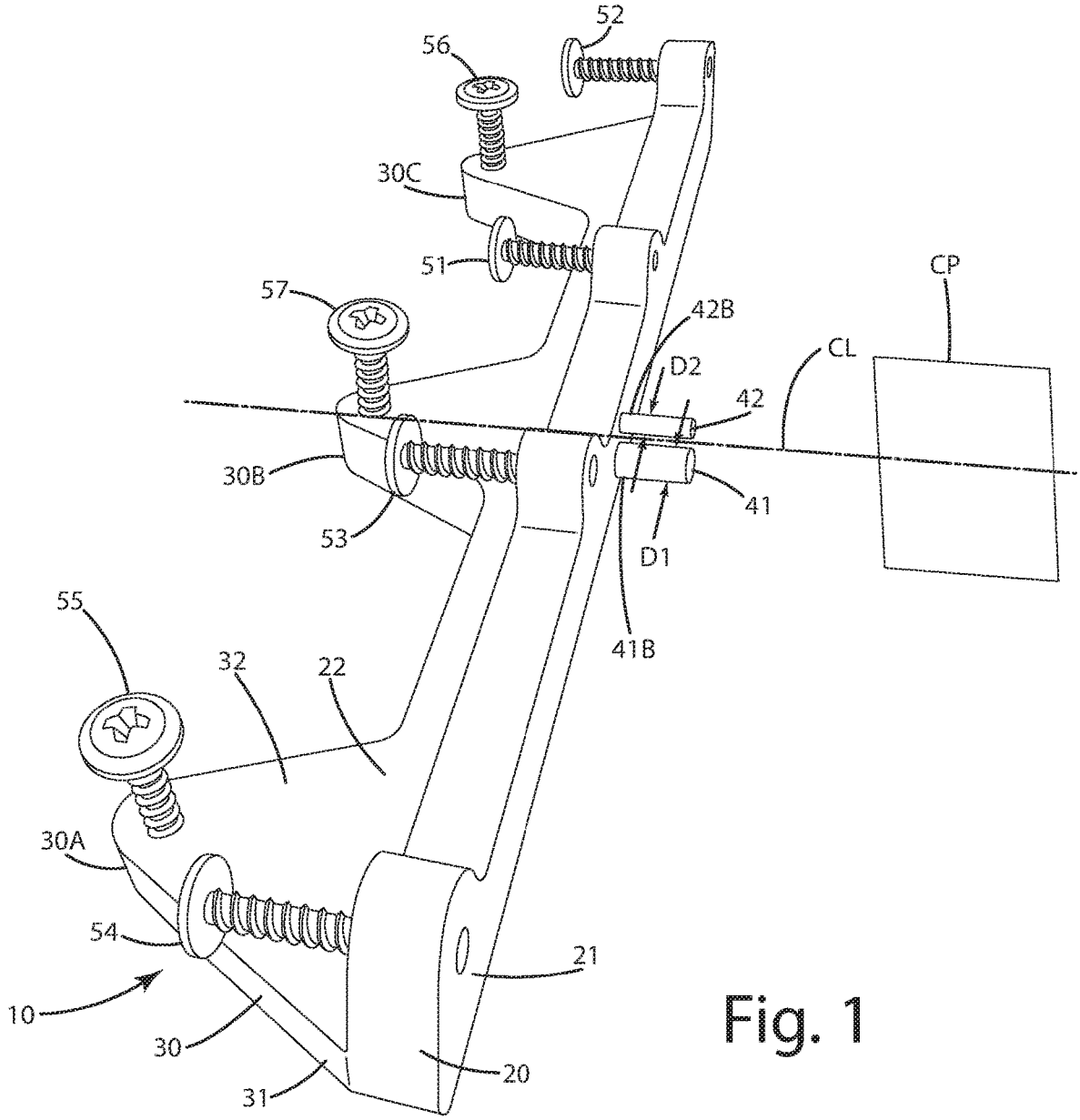
FIG. 1 is a top perspective view of a bracket of a current embodiment.
Figure 2:
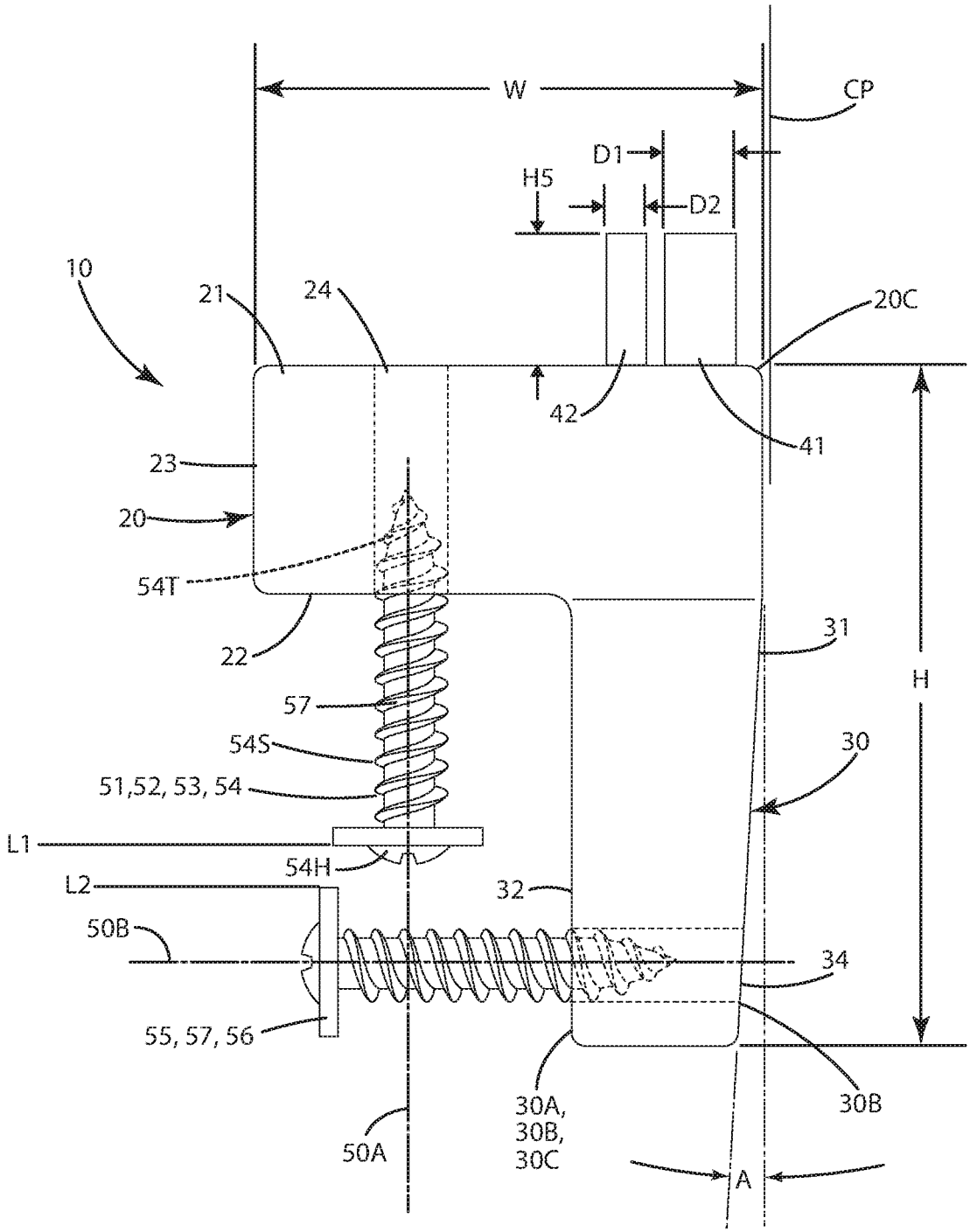
FIG. 2 is a right side view of the bracket.

Turning now to the construction of the bracket, as shown in FIG. 1, the bracket 10 can include a top horizontal leg 20 and a vertical leg 30 joined with the top horizontal leg. Although described in connection with horizontal and vertical orientations, the legs can be offset from perfectly vertical and/or perfectly horizontal when placed or otherwise used in conjunction with a structure. As shown in FIG. 2, the top leg 20 can be integrally formed with the vertical leg 30 so that these legs form a single piece unit. The top leg 20 can include an upper surface 21 or top leg contact surface. This top leg contact surface can be configured to directly engage and contact a board surface, such as the underside of a step board, as described below. Opposite the top leg contact surface 21 is a lower or bottom surface 22. The lower or bottom surface 22 can extend from an outer edge 23 of the top leg toward the vertical leg 30. The top leg 20 and the vertical leg 30 can be arranged at a predetermined angle, for example, optionally 90°, 60°, and or 45°, depending on the particular construction and use of the bracket 10.

Figure 4:
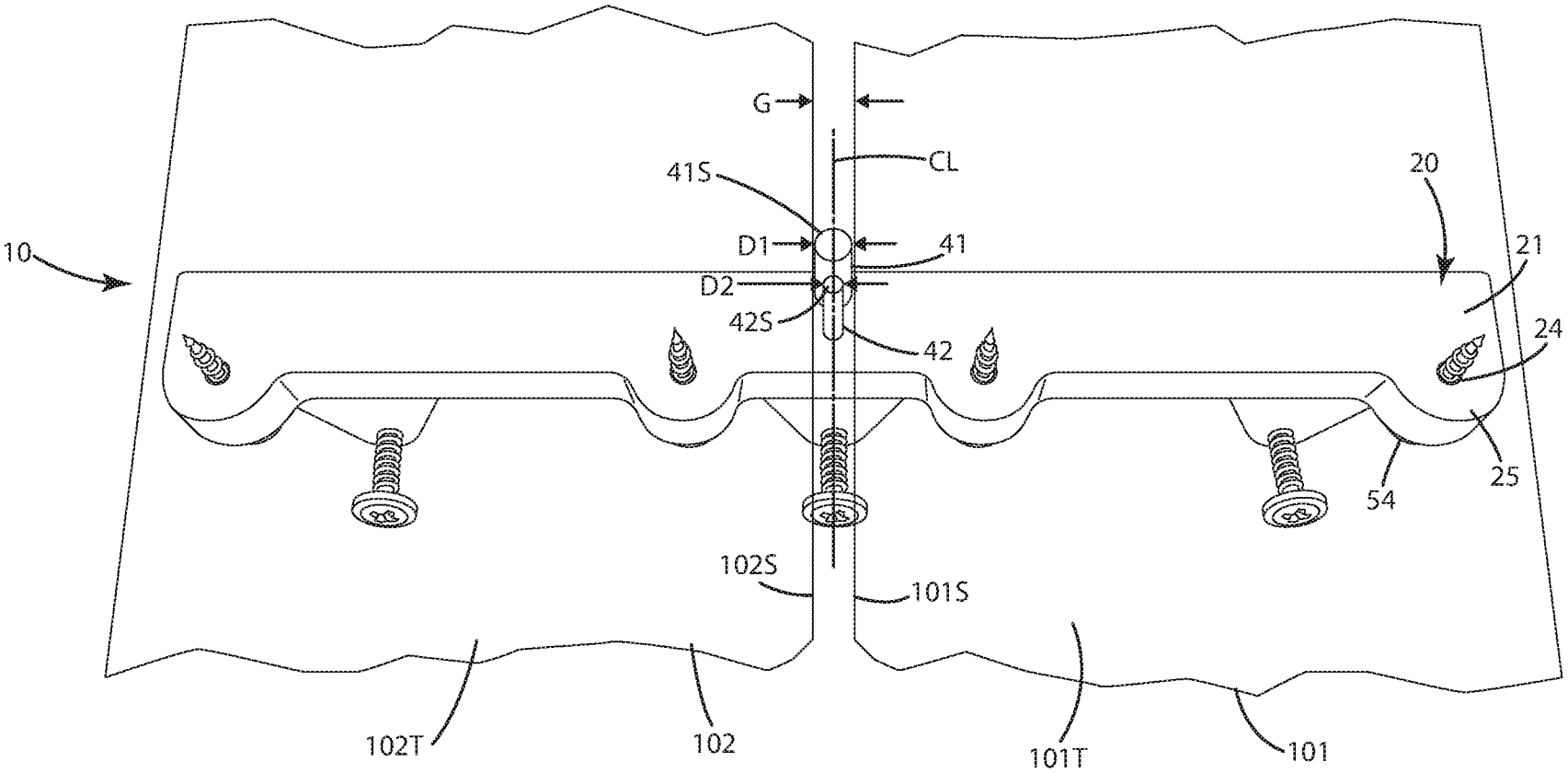
FIG. 4 is a top view of the bracket and boards turned over and prepared for installation relative to a stair stringer with the first and second boards joined by the bracket and turned upside up.

The top leg 20 can define a plurality of fastener holes that extend from the top leg contact surface 21 to the bottom surface 22, optionally through the top leg 20. An exemplary fastener hole 24 is shown in FIGS. 2 and 4. This hole 24 can optionally be slightly smaller in dimension than a shank 54S of a fastener 54. The tip 54T of the fastener 54 can be partially and/or fully disposed in the hole 24. With the tip 54T of the fastener installed in the hole 22, the plurality of threads associated with the shank 54S can be visible and exposed beyond the bottom surface 22 of the top horizontal leg 20. Further, the fastener itself, when the tip is inserted in the hole, can be rigidly and securely joined with the top horizontal leg 20 and the bracket 10 in general. The threads 54S of the fastener can bite into and optionally deform the material, for example, a polymer, of the leg that bounds the hole. With the threads biting into the material, the fastener can be secured or held in a fixed position relative to the bracket and the leg. The fastener 54, as well as other fasteners 51, 52 and 53 all can be fixedly secured in a stationary position relative to the top leg 20 and the bracket 10 in general so that those fasteners, which optionally can be in the form of threaded fasteners with heads, can form part of a movable unit such that fasteners need not later be added or advanced through a portion of the bracket 10. This can eliminate an extra step for a user or installer utilizing the bracket 10. With these preinstalled, pre-placed fasteners, the fasteners themselves also can be properly oriented relative to the holes in the respective legs.

In the embodiment shown in FIGS. 1-4, the top horizontal leg 20 can include a first fastener 51 and a second fastener 52 disposed on opposite sides of a centerline CL of the bracket 10, relative to third 53 and fourth 54 fasteners. These sets of fasteners, for example the first fastener and second fastener, as well as the third fastener and the fourth fastener can be symmetric about the centerline CL. An equal number of fasteners optionally can be disposed on opposite sides of the centerline CL. Of course, in certain applications, one or more fasteners can be eliminated depending on the fasteners and/or the length of the bracket and how it interacts with another structure. Again, the first, second, third and fourth fasteners can all remain fixedly secured to the top horizontal leg before any of those fasteners are advanced when utilizing the bracket 10. All of the fasteners can be installed in corresponding holes like that of the hole 24 described above in connection with the fastener 54. Further optionally, in some applications, the fasteners can be installed later, rather than preinstalled in the respective bracket holes for the fasteners.

The respective fasteners and fastener holes can be associated with wings or tabs 25 of the top vertical leg 20. This can reduce weight and allow the holes 24 and respective fasteners to be placed farther away from the vertical leg. These tabs 25 can extend outward from a body of the leg 20.

As mentioned above, and shown in FIGS. 1-4, the top horizontal leg 20 can be integral with the vertical leg 30. The vertical leg 30 can include an outer or side surface 32 and a side contact surface 31 opposite therefrom. This side contact surface 31 can be perpendicular to the upper or top contact surface 21 of the top horizontal leg 20. The vertical leg 30 can include one or more sub-legs 30A, 30B and 30C, which can accommodate respective fasteners and fastener holes. The fasteners and fastener holes can be configured substantially similar to the fastener holes 24 as described above. Further the fasteners, for example the fifth 55, sixth 56 and seventh 57 fasteners can be installed in the respective portions of the vertical leg and/or sub-legs in a manner similar to that described above in connection with the fastener 54 installed in the respective hole 24. The respective holes in the vertical leg, however, can be substantially perpendicular to the holes in the top horizontal leg.

Further, the fasteners associated with the vertical leg, also referred to as the second plurality of fasteners, can extend from the vertical leg. Each of those fasteners can be at least partially disposed in the respective holes in the vertical leg. Thus, each of the fasteners can be configured so that some of the threads and part of the shaft of those respective fasteners are visible adjacent the outer or side surface 32 of the vertical leg. These fasteners can be installed at least partially in the respective holes defined by the vertical leg.

As shown in FIG. 2, the vertical leg 30 can include a bevel 30B. This bevel 30B can transition to the contact surface 31 of the vertical leg. This bevel 30B can be offset an angle A relative to that surface 31. The angle A can be optionally 1°-15° inclusive, 1°-10° inclusive, 1°-5° or other angles, depending on the application. Generally, this bevel 30B can be configured to engage another support structure such as a stringer to guide the bracket into position adjacent the stringer as described below.

Optionally, the top leg 20 and the vertical leg 30 can be configured so that the fasteners associated with the top leg, and the fasteners associated with the vertical leg, are in a particular orientation. For example, as shown in FIG. 2, the heads, for example head 54H of vertical fastener 54, can be at a level LI that is above a level L2 of the uppermost portion of the horizontal fastener 55. Put another way, the head of the fastener 55 can be entirely or partially below the head 54H of the fastener 54. This can be true for the heads of all of the respective vertical fasteners or first plurality of fasteners 51-54, relative to the second plurality fasteners 55-57. When the fasteners are so oriented, the heads of the vertically oriented fasteners in the top horizontal leg will not interfere with the advancement of the horizontal fasteners, for example 55, in the vertical leg 30. Likewise, advancement of the horizontal fasteners, for example 55, 56 and 57 will not interfere with the respective advancement of the vertical fasteners. Optionally, the bracket herein can include any number of fasteners, depending on the particular application.

Further optionally, the respective axes of the vertical fasteners in the top horizontal leg can be oriented in a particular manner. As shown in FIG. 2, the axes 50A of the first, second, third and fourth fasteners can be oriented substantially vertically and substantially parallel to the vertical leg 30. The axes 50B of the fifth, sixth and seventh fasteners can be oriented substantially horizontally and/or parallel to the top horizontal leg 20. The axes 50A and 50B of the respective vertical and horizontal fasteners can be substantially transverse and/or perpendicular to one another. The horizontal fasteners 55, 56, 57 each, can be engaged by tool, as described below without one of the other fasteners interfering with advancement of a particular fastener with a tool. Put another way, the horizontal fasteners can be positioned between the respective vertical fasteners so that advancement of either type of fastener does not impair the other type of fastener.

With further reference to FIG. 2, the top horizontal leg 20 can have a respective first width W and the vertical leg 30 can have respective first height H. To provide the spacing of the vertical fastener heads and horizontal fastener heads at different levels, for example, level LI and a level L2, the first width and the first height can be in a particular ratio. This particular ratio also can provide particular spacing and sizing for the respective top leg and vertical leg for attachment to a board or another structure. As an example, the ratio of the first width W to the first height H can be optionally at least 1:2, at least 1:3, at least 1:4 or at least 1:5. In some applications, the first width and first height can have particular values. For example, the first width can be optionally between ½ inch and 1 inch, inclusive, between ½ inch and 2 inches, inclusive, or between ½ inch and 3 inches, inclusive. The first height can be optionally between 1 inch and 2 inches inclusive, between 1 inch and 3 inches, inclusive, or between 1 inch and 4 inches, inclusive.

As shown in FIGS. 1 and 2, the top horizontal leg 20 can include or otherwise be joined with a first spacer 41 and a second spacer 42. Other spacers, for example third, fourth and fifth spacers (not shown) can optionally be associated with the top horizontal leg in other applications. The first spacer 41 as shown can have a first dimension D1 while the second spacer 42 can have a second dimension D2 that is smaller than the first dimension D1. These dimensions can be taken across an upper surface or width of the spacers. While the dimensions D1 and D2 can be different, the relative height HS of the spacers 41, 42 can be equal, as described below. The spacers can be intersected by a common plane CP through which the center line CL of the bracket 10 extends. This common plane CP can also bisect the bracket into symmetric left and right sides. Optionally, the first spacer 41 second spacer 42, and any additional spacers can be centered along the center line CL of the bracket.

As mentioned above, the spacers can have different dimensions. These dimensions can be selected to correspond to a preselected gap between boards with which the bracket will be used as described below. In some cases, the first dimension and the second dimension can each be between 1/32 inch and ½ inch, inclusive. Optionally, the first dimension can be ¼ inch or greater, and the second dimension can be less than ¼ inch. Further optionally, the first dimension can be a ¼ inch and the second dimension can be ⅛ inch. Of course, other dimensions can be selected depending on the application and the spacing, that is the preselected gap G as described below.

With reference to FIGS. 1, 2 and 4, the first spacer 41 and second spacer 42 optionally can be cylindrical. The spacers can project upward from the top engagement surface 21 a preselected height HS. The height HS can be optionally less than a thickness of an associated stair board or other board to which the bracket 10 is joined. For example, the height HS can be less than ¾ inch, less than 1 inch, less than 1.5 inch, between ⅛ inch and ¾ inch inclusive, between ⅛ inch and ½ inch, inclusive, or between ⅛ inch and 1 inch inclusive. In some cases, the cross sections of the shape of the spacers can be altered, for example the spacer cross sections can be rectangular, elliptical, triangular or other shapes. Although the heights of the spacers is shown as equal, those heights can vary depending on the application.

Each of the first 41 and second 42 spacers optionally can be integrally formed with the remainder of the bracket and the top horizontal leg. For example, the spacers and the bracket can be formed of a homogeneous polymeric material. Of course, the spacers and the remainder of the bracket can be constructed from other materials, such as composites, metals, and combinations thereof. Each of the respective spacers 41, 42 can be altered or not altered in a step of a process. For example, when altered, one or both of the spacers can be removable, bendable, breakable, foldable, retractable, or able to be modified so that they will not be disposed between boards when the bracket is attached to the boards. In some cases, a spacer can be broken off or bent, so as to not project between adjacent boards and thereby produce or set a gap between those boards. The larger first spacer can be altered so that only the smaller second spacer can project between boards to set the gap therebetween. When a particular spacer is not altered, it generally is not removed, bent, modified, broken off, retracted or otherwise modified.

Where a spacer is configured to be altered by breaking it off, the bracket can be constructed from a polymeric or other breakable or fracturable material. The polymeric material optionally can be weakened at a base 41B or 42B of a spacer. In some cases, the bases can be scored, perforated or have a hole or groove to enable them to be easily removed by a user. In use, none, one or two or more of the spacers can be removed from the bracket to set a particular spacing or gap G between boards. For example, where the first spacer 41 dimension D1 is ¼ inch and the second spacer 42 dimension D2 is ⅛ inch, and a user wants to utilize a preselected gap G of ⅛ inch, the user will snap, break and/or otherwise alter the first spacer so that the dimension D1 is not established between adjacent side surfaces of boards to which the bracket is connected as described below. Instead, the dimension D2 can be established therebetween to set the gap.

Figure 5:
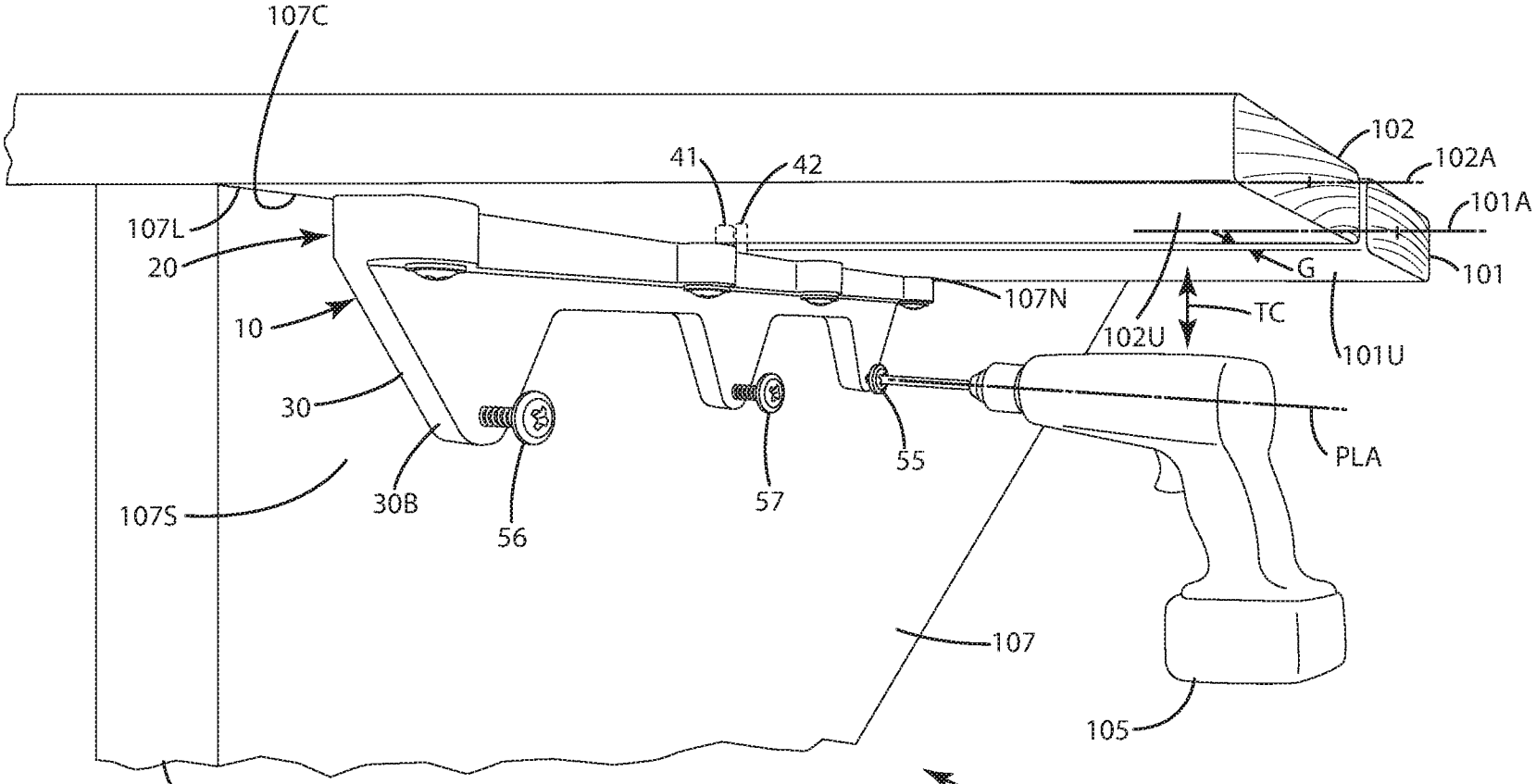
FIG. 5 is a perspective bottom view of the bracket installed on the stair boards and further being installed relative to a stair stringer.
Figure 6:
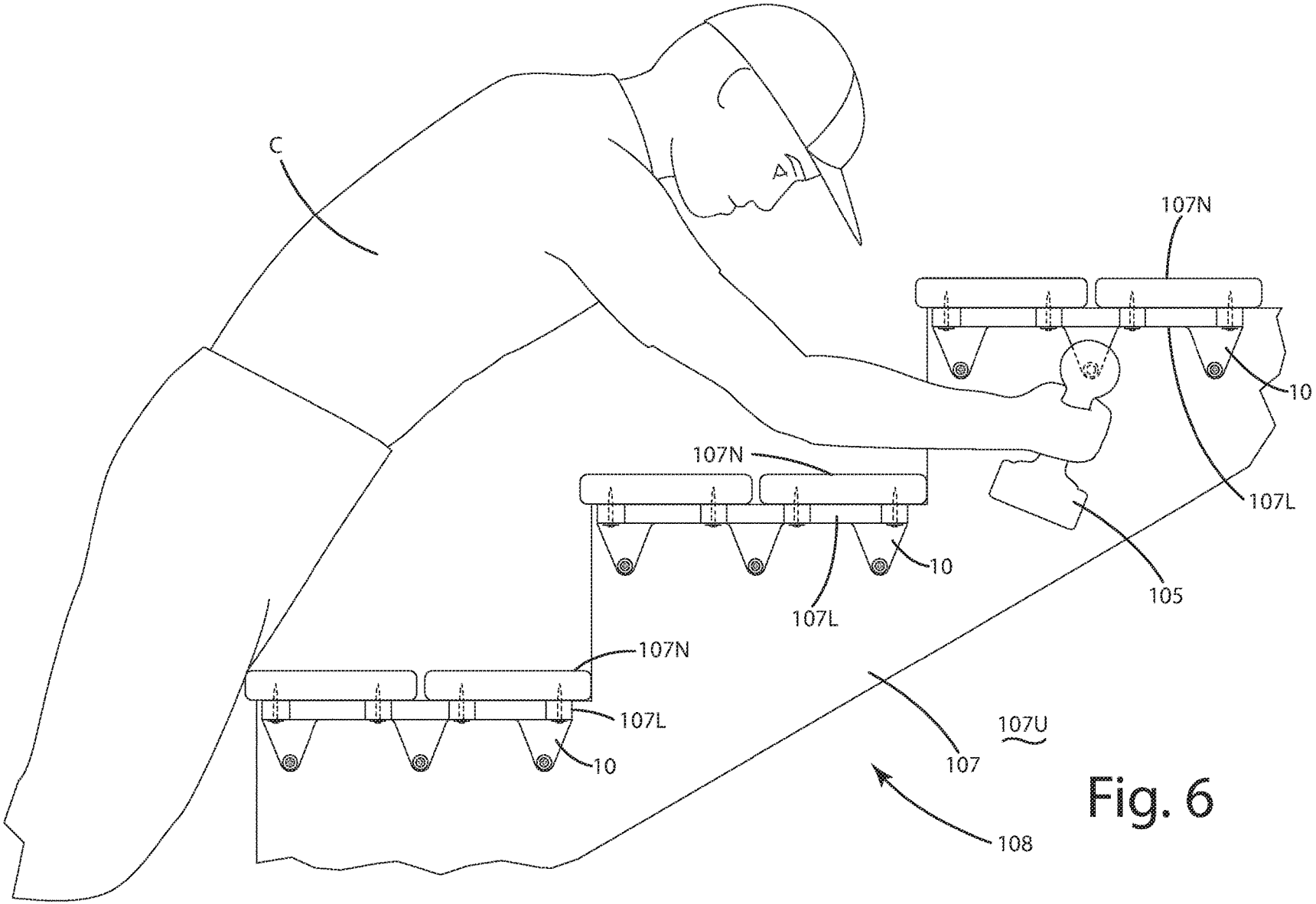
FIG. 6 is a side view of a stairway with multiple brackets securing multiple sets of stair boards on multiple levels of the stair stringer.
Figure 7:
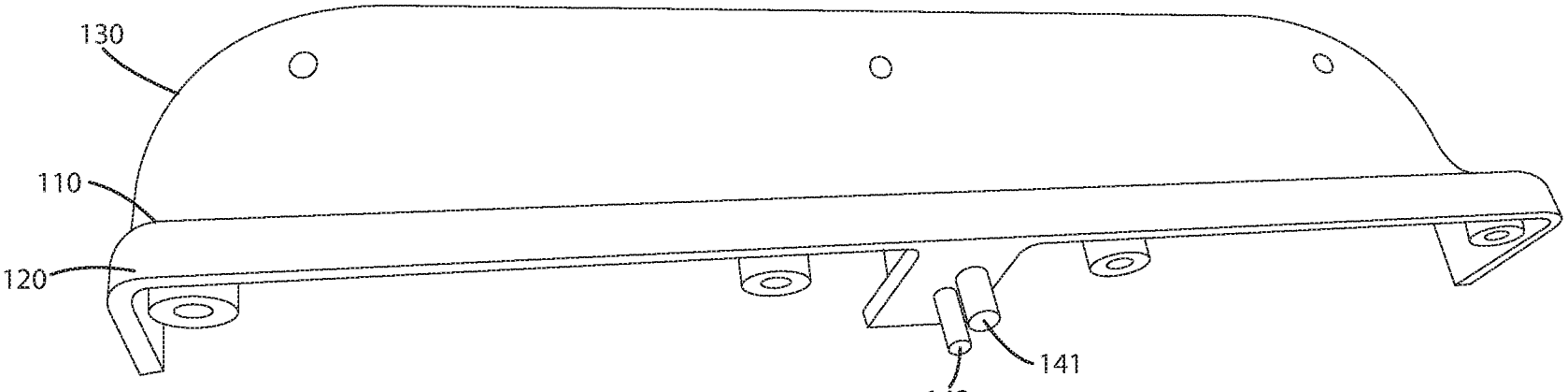
FIG. 7 is an upper perspective view of a first alternative embodiment of the bracket.
Figure 8:
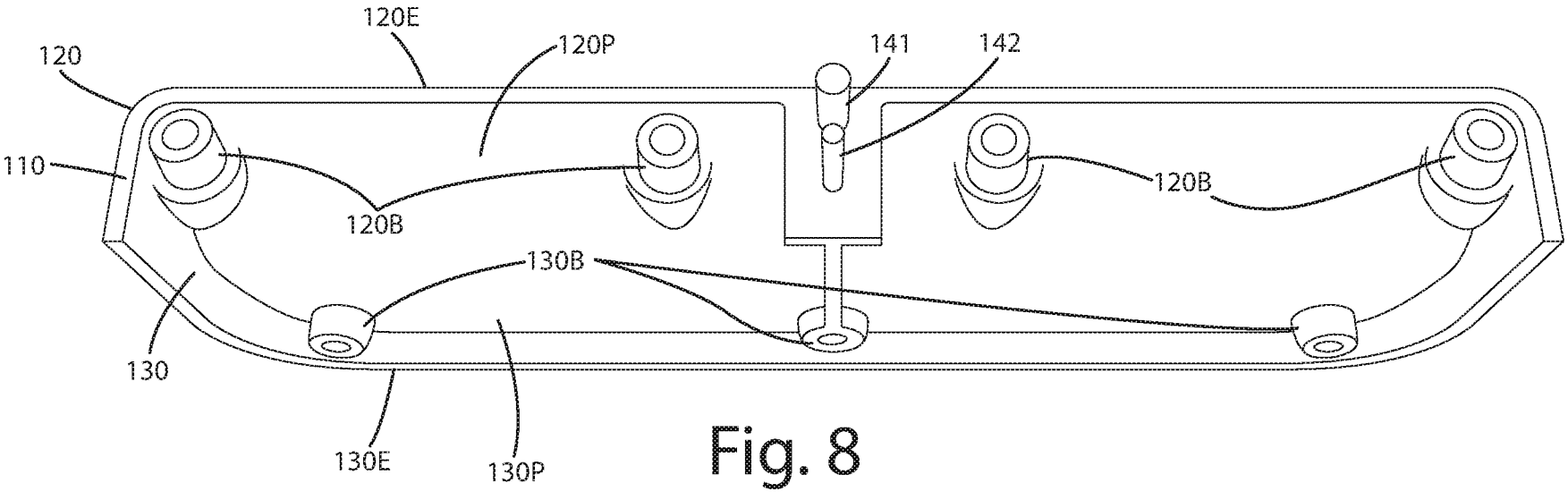
FIG. 8 is a top perspective view thereof.
Figure 9:
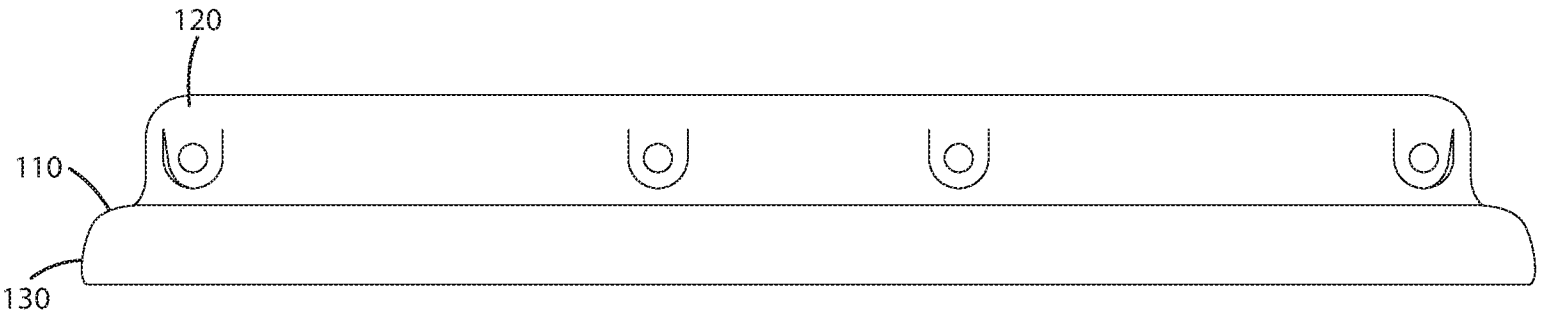
FIG. 9 is a bottom view thereof.
Figure 10:
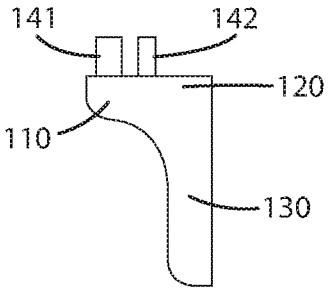
FIG. 10 is a side view thereof.

A method of using the bracket of the current embodiment will now be described with reference to FIGS. 1-6. The bracket 10 can be utilized in conjunction with building a stairway. The stairway can initially be constructed by an installer or user C who can cut one or more stringers 107 to include multiple notches 107N as shown in FIG. 6. These notches 107N can have multiple levels 107L of horizontal surfaces to which stair boards, for example, a first stair board 101 and a second stair board 102 can be joined.

The bracket 10 however can simplify the overall process and allow the installer C to work with units of stair boards rather than individual stair boards. Further, those units of stair boards can have boards that are properly and consistently spaced from one another with a preselected gap G as described below. In addition, the installer or user C operating a tool, such as a power drill 105, is able to remain substantially above the stringer 101 while operating the tool, rather than position the user's body substantially under the stringer, the first board and/or the second board, in a space 107U under those elements. Thus, the user can be generally more comfortable than when installing a set of stair boards on a stringer in a conventional manner, in which the user would climb under the stringer and stair boards to install some other type of fasteners from below the stair boards.

Returning to method herein, a user or installer C can begin to build a stairway 108 by cutting multiple notches 107N in a stringer 107, for example, as shown in FIG. 6. The notches can include multiple different levels 107L. Each of those levels can generally include a horizontal surface upon which one, two, three or more stair boards can be placed. In the exemplary construction, first 101 and second 102 stair boards can form each respective step on the different levels in the notches on the stringer 107.

The user C can cut the stair boards and place them preliminarily in a respective notch 107N and on the stringer 107. The user can take a marker, such as a pencil or other writing or marking utensil and mark a marker line ML by moving the marker along the stringer so that the marker leaves a marker line on the undersides 101U and 102U of the respective first and second boards along a line that is generally parallel to the side/vertical surface of the underlying stair stringer 107. Where there are more stringers, the user can mark additional marker lines to accommodate additional brackets.

Figure 3:
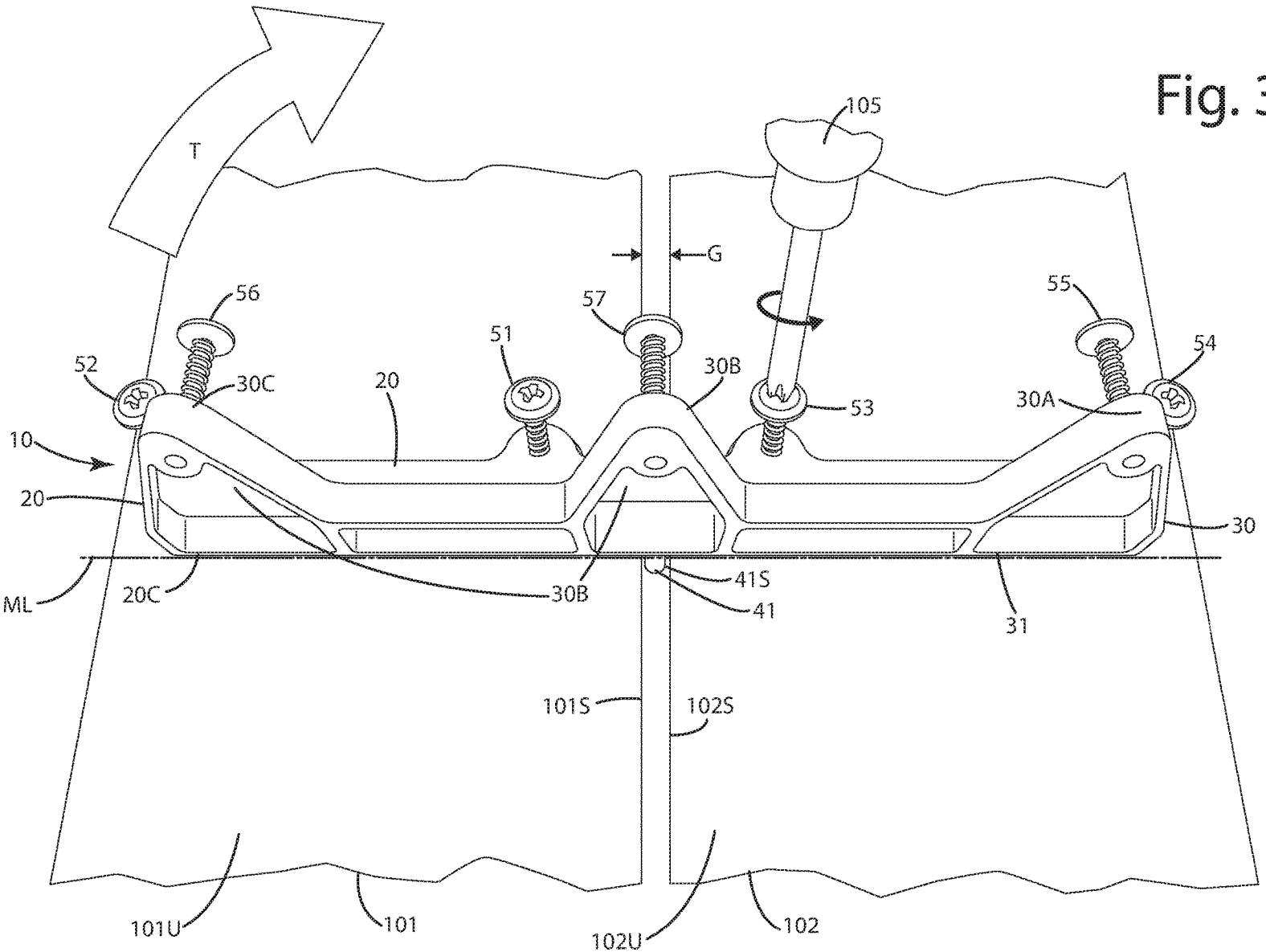
FIG. 3 is a bottom view of the bracket being installed relative to the undersides of first and second stair boards, the bracket setting a preselected gap between the boards.

The user can turn the boards over so that the undersides 101U and 102U are exposed as shown in FIG. 3. The user can align the bracket 10 with the marker line ML. In particular, the corner edge 20C of the bracket 10 can be placed parallel to the marker line ML, optionally laying adjacent or over that line ML. The top contact surface 21 can then be placed in engagement with the undersides 101U and 102U of the stair boards. The user can move the stair boards toward one another so that their inner side surfaces 1015, 102S engage at least one of the first spacer 41 and the second spacer 42 to set the preselected gap G. During the placement of the bracket 10 relative to the boards, the user can determine the dimension of the preselected gap, and selectively alter or not alter at least one of the spacers. For example, if the user desires a larger gap G between the boards, where that gap G corresponds to the dimension D1 (see FIG. 4) of the first spacer 41, the user will selectively not alter the first spacer based on the preselected gap G between the first board and the second board. The user then will push the side surfaces 1015 and 102S of the boards against the outer surface or surfaces 41S of the first spacer 41. This accordingly will set the gap G to that first dimension D1 of the first spacer 41. In this configuration, the first spacer can engage the side surfaces of the board, but the second spacer will not engage those surfaces.

On the other hand, if the user desires a smaller gap G between the boards, where that gap G corresponds to the dimension D2 of the second spacer 42, the user will selectively alter the first spacer based on the preselected gap G between the first board and the second board. To selectively alter the first spacer, the user can remove, break, bend, fracture, retract, push, move, extend or otherwise modify the first spacer so that it is not placed between the side surfaces 1015 and 102S of the boards. Optionally, the first spacer can be removed from the bracket. Thus, with the first spacer not placed there, the surfaces 1015 and 102S of the boards can be moved closer to one another until they engage the outer surfaces or surface 42S of the second spacer 42. The second spacer 42 thus sets the gap G at the dimension D2. Of course, where additional spacers of different dimensions are additionally included with the bracket, a user can selectively alter or not alter a number of spacers until the dimension of a particular spacer is selected to set the gap G between the boards. Further, it will be appreciated that multiple brackets with multiple spacers can be utilized to set the gap uniformly from first ends of the first and second boards to second ends of the first and second boards.

With the bracket 10 so aligned, and the preselected gap G set by a respective spacer, the user can operate a tool 105, which optionally can be a rotary power tool such as a power drill with a drive attachment, and engage the respective vertical fasteners. In particular, the user can use the tool 105 to fasten the top horizontal leg 20 to the underside 101U of the first stair board 101 with a first fastener 51 and a second fastener 52 by rotating those fasteners so that they advance into the first board and until the heads of those fasteners engage the bottom surface 22 of the top leg 20. The user can fasten the top horizontal leg 20 to the underside 102U of the second stair board 102 with a third fastener 53 and the fourth fastener 54, which can be rotationally advanced in a manner similar to that of the first and second fasteners. It is to be noted that where the first, second, third and fourth fasteners are preinstalled and secured in place in the respective holes of the top leg 20, those fasteners do not need to be manually handled by user. Thus, they can be simply advanced easily and quickly into the respective boards with a tool.

With the bracket 10 joined with the first and second boards via the plurality of first fasteners 51, 52, 53 and 54, a user can install additional brackets to secure the boards. The bracket accordingly can set the preselected gap G between those boards via the respective spacer. Those boards then can be turned up in direction T so that the undersides 101U and 102U face downward, generally toward a ground surface. FIG. 4 illustrates the boards after they have been turned over and their top sides 101T and 102T face generally upward. In this configuration, the gap G remains set by the dimension D1 of the first spacer 41. The dimension D2 of the second spacer 42 however is smaller than the gap G. Thus, the side surfaces 1015 and 102S can engage the surface or surfaces 41S of the first spacer 41, but not the surface or surfaces of the second spacer 42. The second spacer 42 however remains within the gap G.

With the boards 101 and 102 joined via one or more brackets 10, the user can then place the boards on the horizontal levels 107L of the notches 107N in the stringer 107. For example, the vertical leg 30 of the bracket can be placed adjacent the side surface 107S of the stringer 107. Optionally, as the bracket 10 is so placed, the bevel 30B optionally can engage the corner 107C of the stringer and can guide the vertical leg 30 smoothly over that corner so that the remainder of the vertical leg, in particular the inner contact surface 31, can contact and/or can be placed adjacent the surface 107S of the stringer 107. This alignment and placement of the vertical leg and boards over the level 107L of the stringer 107 can be repeated for multiple brackets and multiple associated stringers of the stairway 108. It will be noted that during this placement of the bracket, the bracket, the first board and the second board remain connected as a single piece unit that can be easily moved and manipulated by the user C. Thus, the user C need not fumble with placing multiple stair boards and then fastening each individual stair board to the stringer. The bracket makes this possible, all while maintaining the preselected gap G between the first and second boards.

With the vertical leg 30 so placed beside the side surface 107S of the stringer 107, the user C can fasten the vertical leg 30 to the stringer via the second plurality of fasteners, which optionally can be the horizontal fasteners, in particular the fifth fastener 55, the sixth fastener 56 and the seventh fastener 57. This fastening also can be done via the tool 105. As shown in FIG. 5, this tool 105 can include a longitudinal drive axis PLA. This longitudinal axis can be oriented substantially parallel to the longitudinal axes 101A, 102A of boards 101 and 102, and generally substantially horizontal, during the fastener advancement. The tool, when in this orientation, can maintain a tool clearance TC relative to the undersides 101U and 102U of the boards. Thus, the spacing of the second plurality of fasteners can be sufficient to allow the power tool 105 to fit in this confined space under the stair boards. In addition, due to the utilization of the bracket 10, as shown in FIG. 6, the user or craftsmen C can remain substantially above the stringer 107 while operating the tool 105. Accordingly, the user need not position their body or their appendages substantially under the stringer, the first board and/or the second board while installing the bracket relative to the stringer 107 to secure the stair boards there too. This in turn eliminates the need for the user to crawl under or into the space 107U under the stringer 107 to install the stair boards to the stringer.

A first alternative embodiment of the bracket is shown in FIGS. 7-10 and generally designated 110. This embodiment can be similar in structure, operation and function to the embodiment described above with several exceptions. For example, the bracket 110 can include a top horizontal leg 120 and a vertical leg 130. The top leg 120 can include first and second spacers 141 and 142 that are configured and dimensioned to provide a preselected gap between first and second boards. This embodiment also can include a plurality of fastener holes in the top horizontal leg 120 and the vertical leg 130. The vertical leg and top leg, however, can be in the form of panels. For example, the top horizontal leg 120 can include a panel 120P that transitions to a vertical panel 130P of the vertical leg 130. Each of these panels can include fastener bosses. For example, the panel 120P can include fastener bosses 120B and the vertical leg 130P can include the fastener bosses 130B. The bosses can define respective holes and may or may not include preinstalled fasteners (not shown). The panels 120P and 130P can transition to respective ledges 120E and 130E that can contact the undersides of the boards and the vertical side of the stringer respectively, along with the bosses. This bracket 110 can offer an aesthetically pleasing configuration and can be molded from a polymeric material or a cast metal. The exterior of the bracket can include a simulated wood grain or wood surface. This bracket and the embodiment of the bracket above can be colored similar to color of wood or other material to which it is joined. This bracket can be installed and used to build stairways or other structures similar to that of the bracket as described above.

Figure 12:
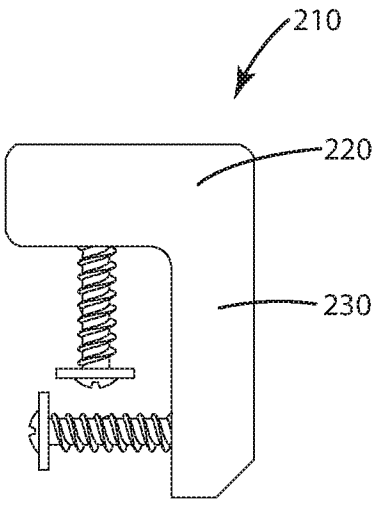
FIG. 12 is a side view thereof.
Figure 13:
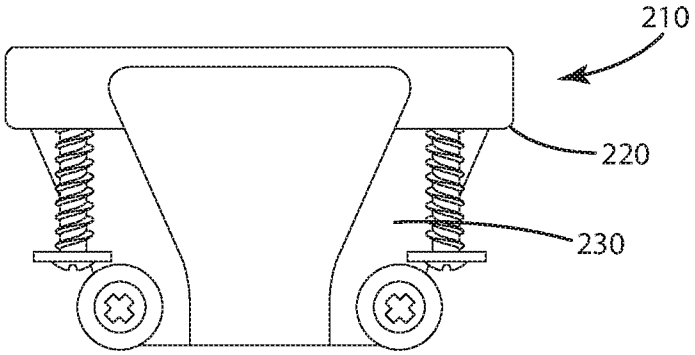
FIG. 13 is a front view thereof.
Figure 11:
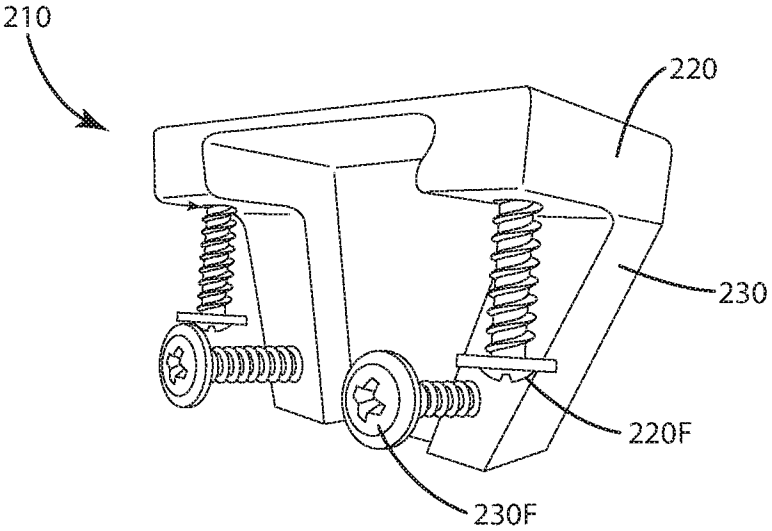
FIG. 11 is a bottom perspective view of a second alternative embodiment of the bracket.

A second alternative embodiment of the bracket is shown in FIGS. 11-13 and generally designated 210. This embodiment is similar to the embodiments described above in structure, function and operation with several exceptions. For example, the bracket 210 can include a top horizontal leg 220 and a vertical leg 230 that are joined with one another. This embodiment, however, can be substantially shorter than the embodiments above and can include fewer fasteners 220F associated with the horizontal leg 220 and fewer vertical fasteners 230F associated with the vertical leg 230. This embodiment also can be void of gap spacers. Thus, this bracket 210 can be utilized to join boards at a corner, without producing any type of gap between those respective boards. The bracket 210 of this embodiment can be installed relative to a structure similar to that of the embodiments described above.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientations.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual elements of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The invention claimed is:

1. A method of assembling a stairway, the method comprising:

providing a bracket having a top horizontal leg having a first width and a first spacer of a first dimension and a second spacer of a second dimension smaller than the first dimension, the top horizontal leg defining at least two fastener holes, the bracket having a vertical leg joined with the top horizontal leg, the vertical leg defining at least two fastener holes, the vertical leg having a first height, the ratio of the first width to the first height being at least 1:2;

marking an underside of a first stair board and a second stair board with a marker line along a stringer adjacent the first and second stair boards;

turning the first stair board and the second stair board over and positioning the top horizontal leg parallel to the marker line;

selectively altering or not altering the first spacer based on a preselected gap between the first board and the second board;

fastening the top horizontal leg to the underside of the first stair board with a first fastener and a second fastener;

fastening the top horizontal leg to the underside of the second stair board with a third fastener and a fourth fastener, while at least one of the first spacer and the second spacer maintains the preselected gap;

turning the first board and the second board over with the bracket attached thereto;

placing the vertical leg of the bracket adjacent the stringer; and fastening the vertical leg to the stringer with a fifth fastener and a sixth fastener with a tool, whereby a user operating the tool is able to remain substantially above the stringer while operating the tool, rather than position a body of the user substantially under the stringer, the first board and the second board.

2. The method of claim 1, wherein the preselected gap is smaller than the first dimension, wherein the selectively altering or not altering the first spacer includes altering the first spacer so that the first spacer is not disposed between the first stair board and the second stair board.

3. The method of claim 2, wherein the second spacer is disposed between the first board and the second board, engaging side surfaces of each of the first board and the second board, to set the preselected gap between the first stair board and the second stair board, the preselected gap corresponding to the smaller second dimension.

4. The method of claim 2, wherein the altering the first spacer includes removing the first spacer from the bracket.

5. The method of claim 4, wherein the removing the first spacer from the bracket includes breaking the first spacer off the top horizontal leg.

6. The method of claim 1,
wherein the tool is a power tool,
wherein the power tool includes a longitudinal drive axis,
wherein the longitudinal drive axis is substantially parallel to a longitudinal axis of the first board during the fastening.

7. The method of claim 1,
wherein a bottom of the vertical leg includes a bevel,
wherein the bevel engages the stringer to guide the bracket into position adjacent the stringer.

8. The method of claim 1,
wherein the first, second, third and fourth fasteners all remain fixedly secured to the top horizontal leg before any of the first, second third and fourth fasteners are advanced during the fastening step,
wherein the fifth and sixth fasteners all remain fixedly secured to the vertical leg before any of the fifth and sixth fasteners are advanced during the fastening step.

9. A method of assembling a stairway, the method comprising:
providing a bracket including a top horizontal leg having a first width and a first spacer of a first dimension and a second spacer of a second dimension smaller than the first dimension, the top horizontal leg defining at least two fastener holes, the bracket having a vertical leg joined with the top horizontal leg, the vertical leg having a first height;
placing the top horizontal leg adjacent an underside of a first and a second stair board;
selectively altering or not altering the first spacer based on a preselected gap between the first stair board and the second stair board;
fastening the top horizontal leg to the underside of the first stair board and the second stair board with a plurality of fasteners while at least one of the first spacer and the second spacer maintains the preselected gap;
turning the first stair board and second stair board over with the bracket attached thereto;
placing the vertical leg of the bracket adjacent a stringer; and
fastening the vertical leg to the stringer with a plurality of fasteners with a tool,
whereby a user operating the tool is able to remain substantially above the stringer while operating the tool, rather than position a body of the user substantially under the stringer, the first stair board and the second stair board.

10. The method of claim 9 comprising:
wherein the preselected gap is smaller than the first dimension,
wherein the selectively altering or not altering the first spacer includes altering the first spacer so that the first spacer is not disposed between the first stair board and the second stair board.

11. The method of claim 10,
wherein the second spacer is disposed between the first stair board and the second stair board to set the preselected gap between the first stair board and the second stair board, the preselected gap corresponding to the second smaller dimension.

12. The method of claim 10,
wherein the altering the first spacer includes breaking the first spacer from the bracket, the bracket being constructed from a polymeric material.

13. The method of claim 9,
wherein the first dimension is ¼ inch and the second dimension is less than ¼ inch.

14. The method of claim 13,
wherein the first spacer is cylindrical and the second spacer is cylindrical,
wherein the first spacer and the second spacer are positioned adjacent a first side surface of the first stair board and a second side surface of the second stair board after the fastening step,
wherein the first spacer and the second spacer do not project beyond an upper surface of the first stair board after the fastening step.

15. The method of claim 9,
wherein each of the plurality of fasteners are secured to and project from the respective top leg and vertical leg before the bracket is placed adjacent the first and second stair boards.

16. A stairway stringer bracket comprising:
a top horizontal leg having a first width and a first spacer of a first dimension and a second spacer of a second dimension smaller than the first dimension, the top horizontal leg defining at least two fastener holes, and
a vertical leg joined with the top horizontal leg, the vertical leg having a first height, with a ratio of the first width to the first height being at least 1:2,
wherein the first spacer is in the form of a first post projecting upward from the top horizontal leg and configured to set a first gap between adjacent boards,
wherein the second spacer is in the form of a second post projecting upward from the top horizontal leg and configured to set a second gap, smaller than the first gap, between adjacent boards.

17. The stairway stringer bracket of claim 16 comprising:
a first plurality of fasteners secured to and projecting from the top horizontal leg, each of the fasteners having a plurality of threads visible adjacent a bottom surface of the top horizontal leg; and a second plurality of fasteners secured to and projecting from the vertical leg, each of the fasteners having a plurality of threads visible adjacent a side surface of the vertical leg.

18. A stairway stringer bracket comprising:
a top horizontal leg having a first width and a first spacer of a first dimension and a second spacer of a second dimension smaller than the first dimension, the top horizontal leg defining at least two fastener holes, and
a vertical leg joined with the top horizontal leg, the vertical leg having a first height, with a ratio of the first width to the first height being at least 1:2,
wherein the first width is between ½ inch and 1 inch, inclusive,
wherein the first height is between 1 inch and 2 inch, inclusive,
wherein the first dimension and the second dimension are each between 1/32 inch and ½ inch, inclusive.

19. The stairway stringer bracket of claim 17,
wherein the first plurality of fasteners includes at least two fasteners laterally positioned to the left of the first spacer and at least two fasteners laterally positioned to the right of the first spacer,
wherein the second plurality of fasteners includes at least three fasteners spaced along the vertical leg.

20. The stairway stringer bracket of claim 16,
wherein the first spacer is configured to be altered so that the first spacer is removed from the top horizontal leg.

* * * * *